United States Patent [19]

Copeland et al.

[11] 3,970,006

[45] July 20, 1976

[54] PROTECTIVE COVER FOR A MISSILE NOSE CONE

[75] Inventors: Robert L. Copeland, Marion, Va.; Ralph F. Greene, Wichita Falls, Tex.; David R. Beeler, Cincinnati, Ohio; Robert A. Eastridge, Saltville, Va.; Vance A. Chase, Poway, Calif.

[73] Assignee: The United States of America as represented by the Secretary of the Air Force, Washington, D.C.

[22] Filed: Jan. 16, 1975

[21] Appl. No.: 541,487

[52] U.S. Cl. ..... 102/105; 89/1.817; 244/117 A; 244/163

[51] Int. Cl.[2] ..... F42B 13/00

[58] Field of Search ..... 102/49.4, 24 HC, 49.5, 102/105; 89/30, 1.817; 244/163, 117 A

[56] References Cited

UNITED STATES PATENTS

| | | | |
|---|---|---|---|
| 3,135,204 | 6/1964 | Menichelli | 102/49.5 |
| 3,172,330 | 3/1965 | Lidmaln et al. | 89/1.817 |
| 3,248,072 | 4/1966 | Schimmel | 102/24 HC |
| 3,500,717 | 3/1970 | Sautier | 89/1.817 |
| 3,616,140 | 10/1971 | Copeland et al. | 102/105 |

*Primary Examiner*—Harold Tudor
*Attorney, Agent, or Firm*—Joseph E. Rusz; Richard J. Killoren

[57] ABSTRACT

A missile nose cone removable protective cover having a rigid outer shell of cross-linked polyethylene with a semirigid backing of polyurethane foam. A shaped linear charge is positioned in a serpentine pattern between the rigid outer shell and the foam backing. The shaped linear charge is detonated by means of a detonator in an epoxy junction box in the forward end of the nose cover.

2 Claims, 3 Drawing Figures

PROTECTIVE COVER FOR A MISSILE NOSE CONE

RIGHTS OF THE GOVERNMENT

The invention described herein may be manufactured and used by or for the Government of the United States for all governmental purposes without the payment of any royalty.

BACKGROUND OF THE INVENTION

When missiles are not carried in the bomb bay of an aircraft but are mounted externally, they are continually exposed to the elements and repeated flights before being fired. The nose cones of these missiles are exposed to rain erosion and to conditions of impact shock and abrasion from stones, sand, dust, mud and other debris during each take-off and landing. There is no known system for providing a protective cover for missile nose cones during captive flight with a system for removing the covering before arming and firing of the missile. Care must be taken in the removal of the cover so that the nose cone is not damaged.

BRIEF DESCRIPTION OF THE INVENTION

According to this invention, a protective cover of a rigid cross-linked polyethylene outer shell is provided with semirigid polyurethane foam backing. A shaped linear charge is provided in a serpentine pattern between the outer shell and the foam backing. The ends of the shaped linear charge are placed in contact with a detonator to insure reliable firing.

IN THE DRAWING

DETAILED DESCRIPTION OF THE INVENTION

Figure 1:
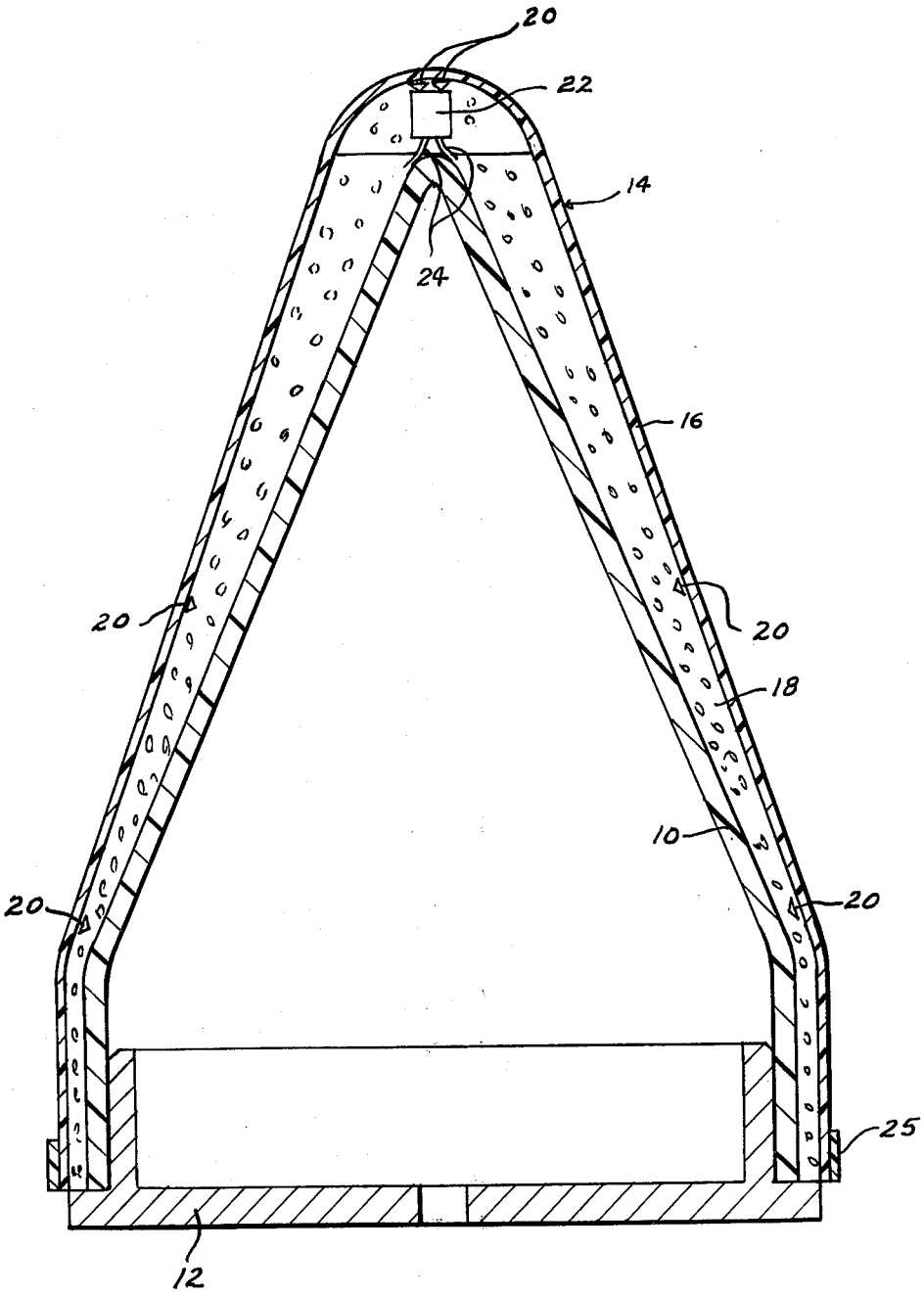
FIG. 1 is a partially schematic sectional view of a missile nose cone with a protective cover according to the invention.
Figure 2:
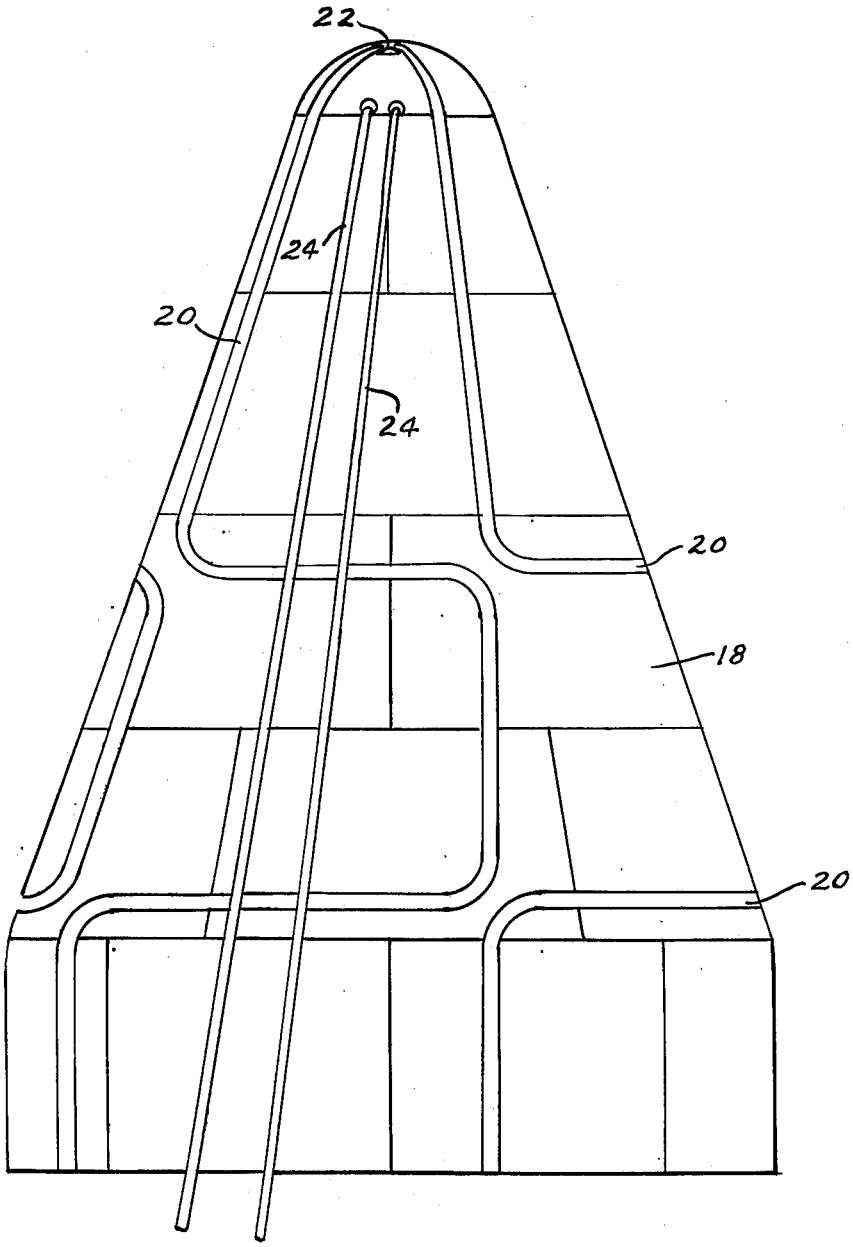
FIG. 2 is a schematic view showing one, shaped linear charge pattern which may be used with the device of FIG. 1.

Reference is now made to FIG. 1 of the drawing which shows a missile nose cone 10 mounted on an attachment ring 12. The nose cone may be made of a rigid plastic, a ceramic material or other material. The nose cone has a protective cover 14, with a rigid outer shell 16 and a foam backing 18. A shaped linear charge 20 is positioned between the outer shell 16 and backing 18, in a serpentine path, as shown in FIG. 2. A detonator, not shown, is located in a junction box 22. The shaped linear charge lines have their ends pinch cut, so as to seal the ends. The ends are placed in contact with the detonator in junction box 22 and held in place with an adhesive. Electric power for detonating the charge is supplied over lines 24.

The outer shell 16 is vacuum formed cross-linked polyethylene. In the device tested, the thickness of the outer shell was 0.10 inches. The backing material 18 was made of a polyurethane foam with a minimum thickness of 0.30 inches. The polyurethane foam can be either preformed and cut in sections and fitted into place around the nose cone or it can be formed in place between the nose cone and the outer shell. By forming in place, production costs are reduced.

If preformed cut sections are used, the shaped linear charge 20 can be positioned in slots formed in the polyurethane foam as shown in FIG. 2. When the backing is formed in place, the shaped linear charge would be secured to the outer shell before the shell is placed over the nose cone. The serpentine pattern used, as shown in FIG. 2, solves problems which occur when crossover junctions are used.

The shaped linear charge used was three grain per linear foot RDX, encased in lead. Five grain per linear foot charge was tried and found not to damage the nose cone. However, since the three grain per linear foot was found to cut the outer shell, the five grain charge was not needed.

Figure 3:
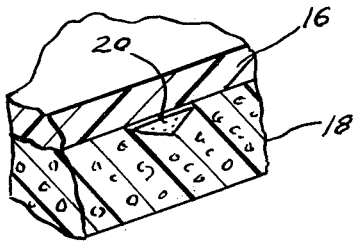
FIG. 3 is an enlarged cutaway view of the shaped charge in place between the outer shell and foam backing in the device of FIG. 1.

The shape used for the shaped linear charge was a triangular shape, as shown in FIG. 3, with the apex of the triangle away from the outer shell. The triangle was 0.098 inches across the base with a thickness of 0.070 inches near the apex. The triangular shape is used since the major force generated by the explosive charge is directed away from the apex of the triangle. Thus, the major force generated by the shaped charge is utilized to cut the outer shell with a minimum force being directed toward the missile nose cone.

The detonator used was a Unidynamics Corporation detonator containing 1.9 grains of RDX and designated as UD-S120. The detonator was positioned within a junction box made of an epoxy material with power being supplied to the detonator over leads 24.

The cover is held in place by aerodynamic pressure during flight. Therefore, the cover need be held only against deceleration forces. This may be accomplished with a pluarlity of setscrews around the base or with a nylon base strap 25 tightened circumferentially around the base.

In use the protective cover will protect the missile nose cone against rain, hail, sand and other debris and will withstand temperatures between −40°F. and 400°F.

Before arming and launch, of the missile, electrical power is supplied to the detonator over leads 24. The detonator then detonates the linear charge 20 to cut the outer shell 16. Both the outer shell and backing are then removed by aerodynamic forces.

There is thus provided a protective covering for a missile nose cone, for use during captive flight, which can be removed without damage to the missile nose cone.

We claim:

1. A protective cover for a nose cone of a missile, normally mounted external to an aircraft in captive flight, which is removable before arming and firing of the missile, comprising: a rigid cover of cross-linked polyethylene spaced from said nose cone; a semirigid backing of polyurethane foam in the space between the missile and said cover; a linear triangular shaped charge positioned in a pedetermined serpentine pattern between the cover and the backing; the apex of the triangle of said triangular shaped charge being remote from said cover; means for detonating said linear triangular shaped charge to thereby cut the cover to permit removal of the cover and backing by aerodynamic forces.

2. The device as recited in claim 1 wherein the means for detonating the linear triangular shaped charge includes an electrically activated detonator in an epoxy junction box with the end of the shaped linear charge being held in contact with the detonator with an adhesive.

* * * * *